US006116553A

United States Patent [19]

McKee

[11] Patent Number: 6,116,553

[45] Date of Patent: Sep. 12, 2000

[54] FIREWORKS DISPLAY STAND

[76] Inventor: Scott A. McKee, 7651 Farmgate Way, Citrus Heights, Calif. 95610

[21] Appl. No.: 09/244,452

[22] Filed: Feb. 4, 1999

[51] Int. Cl.[7] ..... A45D 19/04; A47J 47/16; F16M 11/00

[52] U.S. Cl. ..... 248/174; 248/150; 248/152; 248/176.1; 248/174

[58] Field of Search ..... 248/146, 150, 248/151, 152, 159, 176.1, 174

[56] References Cited

U.S. PATENT DOCUMENTS 1,261,138 4/1918 Lauer ..... 248/174

1,822,297 9/1931 Kemery ..... 248/174

3,672,514 6/1972 Tucker ..... 248/152 X

*Primary Examiner*—Ramon O. Ramirez

*Assistant Examiner*—A. Joseph Wujciak

*Attorney, Agent, or Firm*—Heisler & Associates

[57] ABSTRACT

A fireworks display 10 is provided for easy transport to display sites in compact form where it can be unfolded and assembled to place fireworks in an elevated position. The elevated position of the fireworks increase the viewing zone for spectators and allows the fireworks sparks to burn longer as they free fall to the ground. The stand 10 includes first and second vertical panels 30, 40, reinforcing strips 70 for increasing rigidity of the panels 30, 40, and a cap 50 for displaying the fireworks.

6 Claims, 2 Drawing Sheets

FIREWORKS DISPLAY STAND

FIELD OF THE INVENTION

The following invention relates to an apparatus for supporting fireworks for enhanced view by spectators. More specifically, this invention relates to a collapsible fireworks display stand designed to raise stationary fireworks to a height readily visible by an audience and to allow sparks emitted from the fireworks to fall a further distance from the elevated height. The falling sparks naturally burn out as they fall to the ground, further increasing their visibility and burn duration.

BACKGROUND OF THE INVENTION

Many fireworks products are designed to rest on the ground and then be ignited to provide the desired fireworks display. When these products are on the ground, they are not as easily viewed by a crowd, especially children and other viewers of limited height. Also, any sparks which are emitted by the products on the ground land rather quickly and then are either snuffed out or merely burn on the ground. Supporting fireworks upon an apparatus just prior to ignition has long been common practice in the art, especially for rocket-type products. Typically, a rigid stand is erected a safe distance from spectators and the fireworks positioned on or in the stand. The stand serves as a launch platform from which the fireworks propel themselves into the air after ignition.

Such prior art stands have several drawbacks. The launch platforms for high energy fireworks are generally complex, rigid structures that are inappropriate for use with the less energetic fireworks. They are primarily designed to serve as a temporary holder for the fireworks. Also, they are not designed for the spectator to watch the fireworks as they burn on the stand. In fact, if one or more of the highly energetic fireworks remained in the stand, the result could be a conflagration of fireworks igniting prematurely in an uncontrolled fashion. The need to withstand the structural stress induced by highly energetic fireworks, requires that the stand be rigid, heavy, or need additional support as by driving a stake in the ground and supporting the stand through the use of the stake. This makes the use of prior art stands for lower energy stationary fireworks devices inappropriate, cumbersome, and ineffectual.

Alternatively, simply allowing lower energy fireworks to burn up on the ground results in premature burnout and inability of all but a few people to be in the viewing zone. Accordingly, a need exists for an apparatus that can be easily and quickly constructed, will increase the viewing zone of the audience, and will prevent premature burnout of the fireworks.

SUMMARY OF THE INVENTION

The fireworks display stand of this invention solves the problems associated with stand rigidity, the need to increase the viewing zone of fireworks spectators, and extending the burn duration of the sparks emitted from the fireworks. Specifically, the stand incorporates design characteristics that address each problem. First, the display stand is collapsible. Collapsibility is made possible by a combination of components such as slits, folds, and reinforcing parts that permit the length and width of the stand to be reduced when in the folded position and rigid when in the unfolded position.

Second, the stand unfolds from its collapsed position to a height substantially larger than its folded height. Atop the stand is a cap that serves as a holder for the fireworks. The increased height of the fireworks product magnifies the viewing zone of spectators, particularly those having other spectators between them and the fireworks display. The increased height also raises the height of spark emissions and allows the emitted sparks to travel a greater distance and burn out naturally as they fall to the ground. As such, the spark burn duration is increased and therefore the fireworks visuals are magnified.

A typical use of the stand is as follows. A relatively level fireworks display site is selected. The fireworks display stand and fireworks are brought to the site. The display stand is removed from a package containing the stand and all parts necessary for final assembly. The stand is preferably configured to be assembled by: a) unfolding the first of two vertical panels; b) placing reinforcement strips across the two inside folds of the vertical panel; c) unfolding and reinforcing the second panel in like manner to the first panel; d) positioning the base of the first panel above an upper end of the second panel such that a central axis of the first base is essentially perpendicular to a center axis of the upper end; e) aligning a lower slit of the first panel with an upper slit of the second panel; f) sliding the first panel downward over the second panel while maintaining the established relative orientation of the panels until the upper ends and bases of the two panels are essentially flush with each other; and, g) sliding an open end of a cap over the joined upper ends of the two panels.

Once assembled, the stand is placed at the fireworks site and the fireworks placed on the top surface of the cap. After the fireworks products are lit and begin burning, the spectators can view the fireworks show from a safe distance.

The fireworks display stand described above constitutes the basic invention. However, there are some alternatives that may be desireable. One alternative is a clamp reinforcement part in lieu of the rigid strips. These clamp reinforcement parts would slide over both outside edges of each panel. Other alternatives include having the reinforcement strips adhere to the outside surface of the vertical panel or having them adhere to both the outside and inside surfaces simultaneously.

OBJECTS OF THE INVENTION

Accordingly, a primary object of the present invention is to provide a fireworks display stand that is collapsible.

Another object of the present invention is to provide a fireworks display stand that is compact before assembly.

Another object of the present invention is to provide a fireworks display stand that increases the field of view of the spectators.

Another object of the present invention is to provide a fireworks display stand that extends the burning time of the fireworks and the sparks they emit.

Another object of the present invention is to provide a fireworks display stand that allows the fireworks sparks to burn out naturally as they fall to the ground.

Another object of the present invention is to provide a fireworks display stand that is easy to package.

Another object of the present invention is to provide a fireworks display stand that is easy to transport.

Another object of the present invention is to provide a fireworks display stand that does not require a support stake to hold it in place.

Another object of the present invention is to provide a fireworks display stand that supports fireworks at the highest point on the stand.

Another object of the present invention is to provide a fireworks display stand that can be made in shapes and sizes of various characters and objects.

Another object of the present invention is to provide a fireworks display stand that enhances the visual appeal of a fireworks show by depicting colorful characters and objects which relate to the patriotic themes.

Other further objects of the present invention will become apparent from a careful reading of the included drawing figures, the claims and detailed description of the invention.

DESCRIPTION OF THE PREFERRED EMBODIMENT

Figure 2:
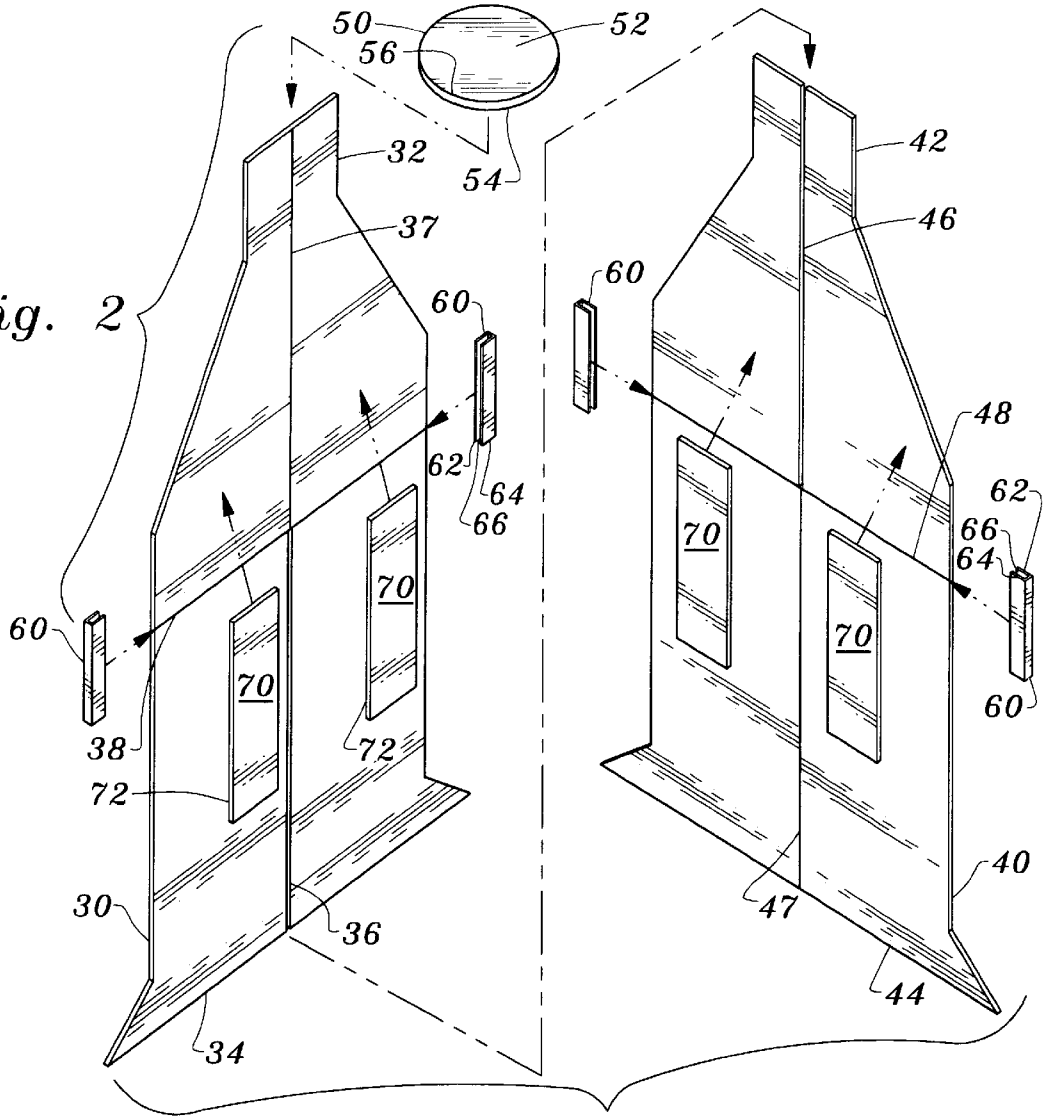
FIG. 2 is a front, exploded, perspective view of the stand exhibiting the major components of the stand and their interrelationships during assembly.

Referring to the drawings, wherein like reference numerals represent like parts throughout the various drawing figures, reference numeral 10 (FIG. 1) is directed to a collapsible fireworks display stand for holding fireworks while they are burning. The stand 10 elevates the fireworks to a height that makes a fireworks show more readily visible to a larger number of spectators. The stand 10 also allows the sparks to free fall to the ground, thereby increasing their burn duration and the magnitude of the fireworks show.

Figure 1:
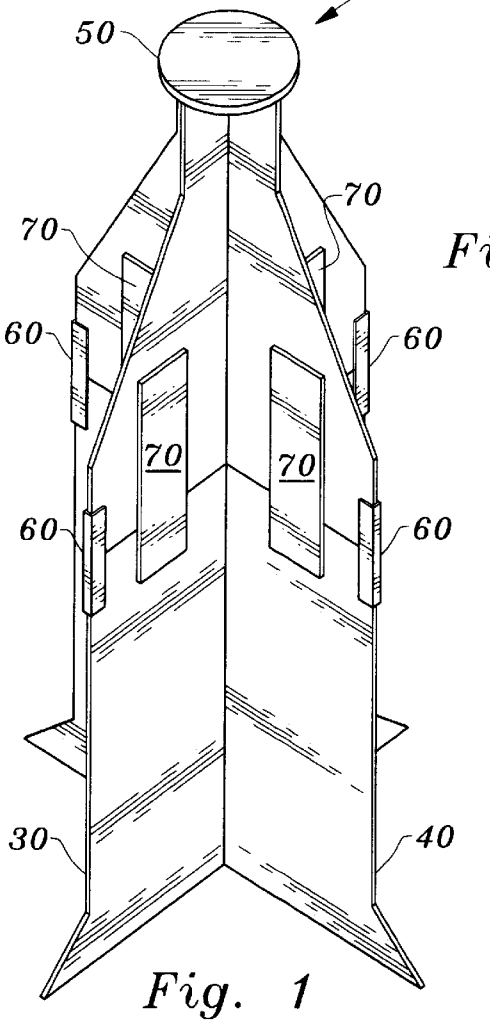
FIG. 1 is a front perspective view of the collapsible display stand of this invention exhibiting the major components of the stand and their general arrangement when the stand is fully assembled.

In essence, and with particular reference to FIGS. 1 and 2, the stand 10 preferably includes a first vertical panel 30, a second vertical panel 40, a cap 50, and at least two strips 70. The first and second panels 30, 40 each have respective first and second bases 34, 44 that make contact with the ground to provide support and stability for the stand 10 after it is fully assembled. In addition, the panels 30, 40 have first and second upper ends 32, 42 opposite said first and second bases 34, 44. The upper ends 32, 42 form a cruciform shaped surface upon which the cap 50 rests after the stand 10 is assembled. The fireworks are placed on a top surface 52 of the cap 50.

More specifically, and with particular reference to FIG. 2, details of the stand 10 are provided. The first vertical panel 30 has a periphery in the preferred embodiment of this invention shaped to define a planar cross-section similar to the shape of a rocket. The second vertical panel 40 has a like peripheral shape. However, numerous other peripheral shapes may be utilized in alternate embodiments. Such shapes include the hand and torch of the Statue of Liberty, the Liberty Bell, the flag, animals, cartoon characters and virtually any shape that can be defined by an enclosed periphery. The panels 30, 40 in the preferred embodiment of this invention are preferably made of a cellulosic material such as corrugated cardboard. However, any material that is relatively lightweight, hingable, and is relatively easy to form and cut, is acceptable for the purposes of this invention.

The first base 34 of the first panel 30 is defined by the portion of the periphery at the bottom of the panel 30. The base 34 periphery is parallel to the ground up to the maximum width of the base 34. At approximately the midpoint of this portion of the periphery, there exists a discontinuity that defines the beginning of a lower slit 36 in the first panel 30. The lower slit 36 extends essentially perpendicularly from this discontinuity in the periphery to a point approximately halfway between the upper and lowermost points on the periphery of the first panel 30. The width of the lower slit 36 of the first panel 30 is slightly larger than the thickness of the second vertical panel 40 in order to accommodate the second panel 40 when the two panels 30, 40 are joined. The lower slit 36 ends in a juncture point with an upper hinge line 37 and a first hinge line 38.

The upper hinge line 37 begins where the lower slit 36 ends and extends vertically upward from the juncture point to the topmost point on the periphery. The first hinge line 38 extends laterally outward from this juncture point to the lateral periphery of the first panel 30. As such, the first hinge line 38 is essentially parallel to the ground when the stand 10 is fully assembled. In the preferred embodiment of this invention, the upper hinge line 37 and first hinge line 38 are hingable due to the foldability inherent in the corrugated cardboard. However, any form of hinging is acceptable to provide a means to fold the panel 30.

When the first panel 30 is fully extended, at least one strip 70 is preferably adhesively joined to the first panel 30 to support the panel 30 and maintain the vertical posture of the panel 30. The strip 70 in the preferred embodiment of this invention is made of a corrugated cardboard and has a rectangular shape and rectangular cross-section. However, any material such as metal, plywood, plastic or press board that provides adequate rigidity to prevent the first panel 30 from folding back over itself along the first hinge line 38 is acceptable. Additionally, the shape and cross-section of the strip need not be rectangular. The shape could take virtually any form that provides sufficient surface area on either side of the hinge line 38 to properly maintain the rigidity of the first panel 30.

The second panel 40 has several parts analogous to the parts of the first panel 30. The second base 44 of the second panel 40 is defined by the portion of its periphery at the bottom of the second panel 40. However, there is no discontinuity at the approximate midpoint of this portion of the second panel 40 periphery. Instead, there is an end of a lower hinge line 47. The lower hinge line 47 extends essentially perpendicularly from this periphery midpoint to a point approximately halfway between the upper and lowermost points on the periphery of the second panel 40. The lower hinge line 47 ends in a juncture point with an upper slit 46 and a second hinge line 48. The upper slit 46 begins where the lower hinge line ends and extends vertically upward from this juncture point to the topmost point on the periphery. The upper slit 46 intersects the upper periphery of the second panel 40, thereby creating a discontinuity in the periphery.

The upper slit 46 is slightly wider than the thickness of the first panel 30 in order to accommodate the first panel 30 when the two panels 30, 40 are joined together. The second hinge line 48 extends laterally outward from this juncture point to the lateral periphery of the second panel 40. As such, the second hinge line 48 is approximately parallel to the ground when the stand 10 is fully assembled. When the second panel 40 is fully extended, rigidity is maintained by joining at least one strip 70 to the panel 40 in a manner essentially the same as is done for the first panel 30.

The topmost peripheries of the first upper end 32 of the first panel 30 and the second upper end 42 of the second panel 40 form a cruciform surface when the panels 30, 40 are unfolded and joined. A cap 50 rests on this cruciform surface. The cap 50 is essentially disc shaped having a circular planar top surface 52 upon which fireworks may be placed and an open end 54 that rests on the cruciform surface created by the upper ends 32, 42 of the panels 30, 40. A side rim 56 extends down slightly from the top surface 52 and outboard of the panels 30, 40 to help prevent the cap 50 from sliding laterally off of the panels 30, 40.

An alternative embodiment of this invention incorporates clamps 60 in lieu of strips 70 or along with the strips 70 for rigid support of the first and second panels 30, 40. Each clamp 60 has a gap 66 slightly smaller than the thickness of the panels 30, 40. The clamp 60 is preferably made of resilient plastic. The gap 66 is formed by a first jaw 62 and a second jaw 64. The gap 66 is positioned over the lateral periphery of the panels 30, 40 such that a portion of vertical length of the clamp 66 is above the hinge lines 38, 48 and a portion is below. The clamp 66 is pushed toward the centerline until it slides no further, thereby inducing stress in the jaws 62, 64 that tend to hold the clamps 60 in place. One clamp 60 is positioned at each end of the hinge lines 38, 48.

Figure 5:
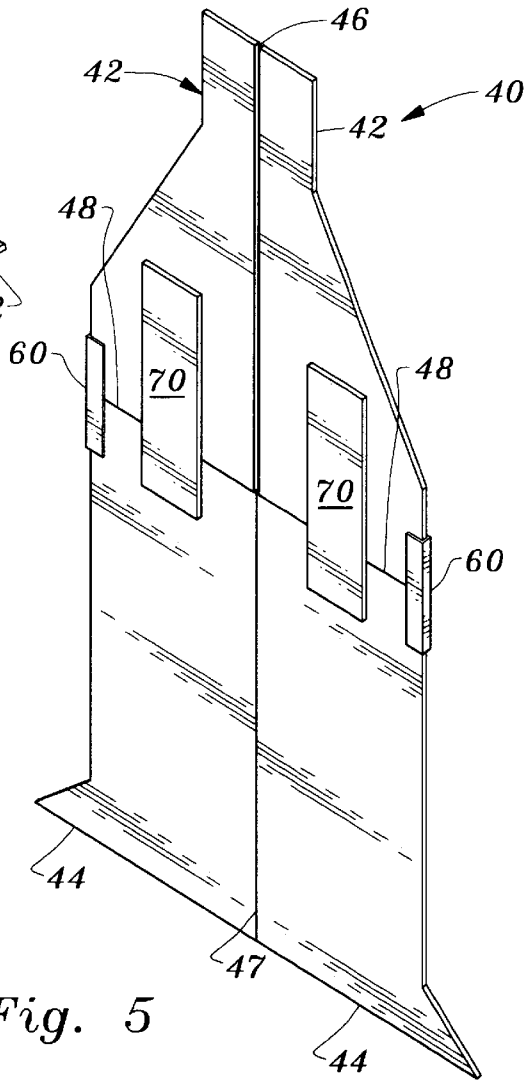
FIG. 5 is a front perspective view of the second vertical panel in its fully open position with clamps and rigid support strips in place.
Figure 4:
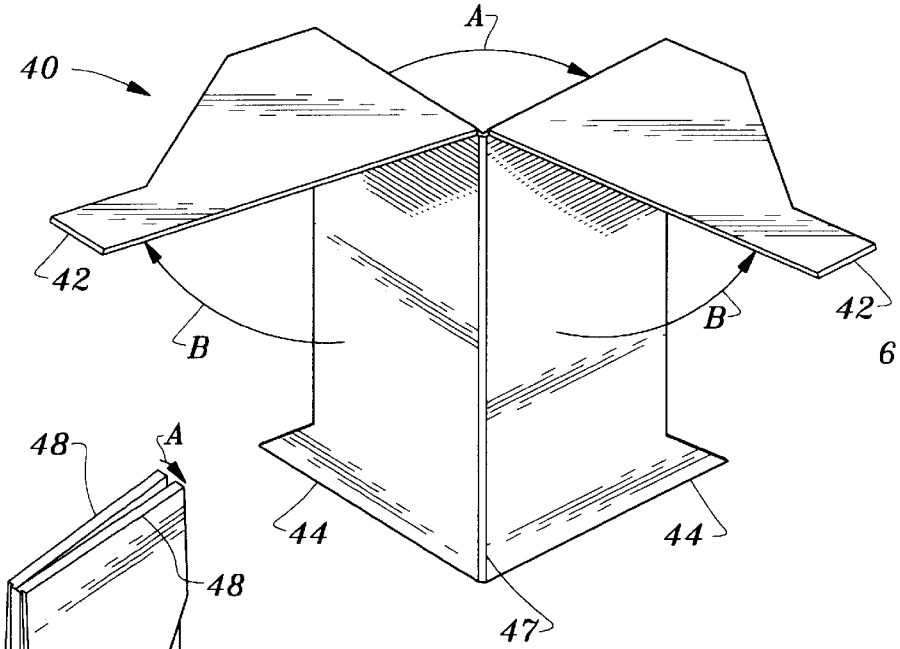
FIG. 4 is a front perspective view of the second vertical panel positioned approximately halfway between its fully collapsed and fully opened positions.
Figure 3:
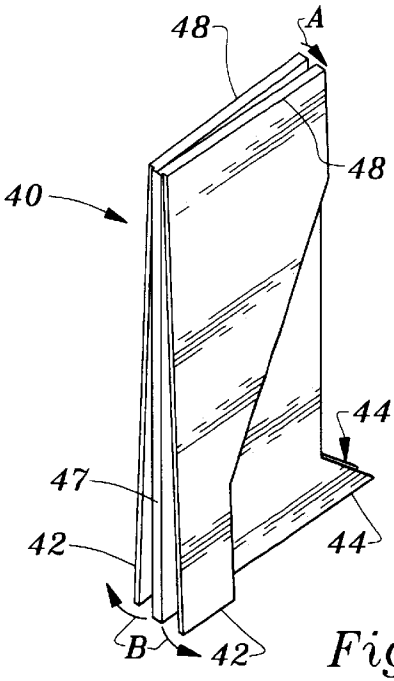
FIG. 3 is a front perspective view of the second vertical panel which is essentially fully collapsed but is just beginning to be opened from its fully collapsed position.

With particular reference to FIGS. 2–5, the use and operation of the stand 10 are provided. In a typical use of the stand 10 a fireworks display site is chosen and the stand 10 is transported to that site. Upon reaching the site, the stand 10 is removed from a carrying container in which the stand 10 and its associated parts have been folded and stored (FIG. 3). The stand 10 is then unfolded, assembled, and used for its intended purpose (FIGS. 3–5).

After removing the stand 10 from the carrying container, the first and second panels 30, 40 are unfolded and the strips 70 attached. The unfolding process is essentially identical for both panels 30, 40. Therefore, the unfolding process for only the second panel 40 will be described (FIGS. 3, 4 and 5). The second panel 40 is removed from the carrying container in a fully folded position. This position is most nearly depicted in FIG. 3. The unfolding is initiated by pulling apart the halves of the panel 40 at the outermost lateral periphery in the direction of the Arrow A, such that the halves of the panel 40 rotate pivotably about the lower hinge line 47. Concurrently, two halves of the second upper end 42 are separated from two halves of the second base 44 in the direction of the Arrows B. The halves of the upper end 42 rotate pivotably about the second hinge line 48 (FIG. 3). The second panel 40 continues to be unfolded by moving the parts in the directions A and B (FIG. 4) until the panel 40 is fully unfolded and erect (FIG. 5).

Once the panel 40 is erect, the strips 70 are joined adhesively to the panel 40 such that there is one on either side of the lower hinge line 47. The strips 70 are positioned vertically so that a portion of each strip 70 is above the second hinge line 48 and a portion of each strip 70 is below the second hinge line 48. A like procedure is followed for the first panel 30. After both panels 30, 40 are assembled, the two panels 30, 40 are joined. This is accomplished by: 1) aligning the lower slit 36 of the first panel 30 with the upper slit 46 of the second panel 40; and, 2) sliding the first panel 30 toward the second base 44 of the second panel 40 until the juncture points of the two panels 30, 40 meet. At this point, the topmost and bottom most peripheries of the two panels 30, 40 are flush with respect to each other. The cap 50 open end 54 is then placed upon and supported by the cruciform surface formed by the first and second upper ends 32, 42 of the panels 30, 40. The collapsible fireworks display stand 10 is now fully assembled and ready for use. The user can place the fireworks product on the top surface 52 of the cap 50 and begin the show (FIG. 1).

This disclosure is provided to reveal a preferred embodiment of the invention and a best mode for practicing the invention. Having thus described the invention in this way, it should be apparent that various different modifications can be made to the preferred embodiment without departing from the scope and fair meaning of this disclosure. When structures are identified as a means to perform a function, the identification is intended to include all structures which can perform the function specified.

What is claimed is:

1. A collapsible fireworks display stand, comprising in combination:

a first vertical panel including a base and an upper end opposite said base;

a second vertical panel separate from said first vertical panel, said second vertical panel including a base and an upper end opposite said base;

an upper slit at least as wide as said first panel extending vertically down from said upper end of said second vertical panel;

a lower slit at least as wide as said second panel extending vertically up from said base of said second vertical panel;

said first vertical panel and said second vertical panel positionable adjacent each other with said first vertical panel extending through said upper slit and said second vertical panel extending through said lower slit;

a cap supportable upon said upper end of said first vertical panel and said upper end of said second vertical panel, said cap including a substantially planar top surface;

wherein said first vertical panel and said second vertical panel each include at least one hinge line extending substantially horizontally across said panels, said hinge lines allowing said panels to be folded back on themselves, such that each of said panels can be collapsed; and wherein said stand includes a means to support each said panel adjacent said hinge lines, such that folding of said panels is resisted when said support means is attached to said panels.

2. The fireworks display stand of claim 1 wherein said fold support means includes at least one clamp having two jaws spaced resiliently from each other by a gap, said gap having a width less than a thickness of said panels when said jaws are at rest, said jaws of said clamp capable of being displaced away from each other to a gap width greater than a thickness of said panels without exceeding an elastic limit of said clamps, such that a closure force is exerted between said jaws; and wherein said at least one clamp is located spanning said hinge line in one of said vertical panels with portions of said clamp connected to portions of said panel on both sides of said hinge line in said panel.

3. The fireworks display stand of claim 1 wherein said support means includes at least one substantially rigid strip, said strip including means to attach to a surface of said panel on opposite sides of at least one of said hinge lines in one of said panels.

4. A collapsible fireworks display stand comprising in combination:

a collapsible support structure including a base and an upper end opposite said base, said structure including at least one continuous vertical panel extending from said base to said upper end;

at least one hinge line in said continuous vertical panel extending across said continuous vertical panel at a location spaced from said base and said upper end, such that a height of said continuous panel between said base and said upper end can be reduced by folding said continuous panel about said hinge line; and wherein said display stand includes a fold support, said fold support attachable to said continuous vertical panel on opposite sides of said at least one hinge line, said fold support sufficiently rigid to resist folding of said continuous vertical panel when said fold support is attached to said continuous vertical panel.

5. The display stand of claim 4 wherein said fold support includes at least two jaws resiliently coupled to each other and spaced from each other by a gap, said gap at least as great as a thickness of said continuous vertical panel, said jaws having sufficient length to extend to opposite sides of said hinge line, such that portions of each jaw can be located on opposite sides of said hinge line.

6. The display stand of claim 4 wherein said fold support includes a substantially rigid strip including an adhesive on an attachment surface thereof capable of securing said attachment surface of said strip to said continuous panel on opposite sides of said at least one hinge line.

* * * * *